US007386144B2

(12) United States Patent
Vincent et al.

(10) Patent No.: US 7,386,144 B2
(45) Date of Patent: Jun. 10, 2008

(54) INERTIAL VOICE TYPE COIL ACTUATOR

(75) Inventors: Stephen Saint Vincent, Ames, IA (US); Robert Katz, Montreal (CA); Sylvain Duchesne, Bromont (CA)

(73) Assignee: Revolution Acoustics, Ltd., Dublin (IE)

( * ) Notice: Subject to any disclaimer, the term of this patent is extended or adjusted under 35 U.S.C. 154(b) by 368 days.

(21) Appl. No.: 10/995,145

(22) Filed: Nov. 24, 2004

(65) Prior Publication Data

US 2006/0115107 A1 Jun. 1, 2006

(51) Int. Cl.
*H04R 1/00* (2006.01)
*H04R 9/06* (2006.01)

(52) U.S. Cl. ..... 381/412; 381/415; 381/404

(58) Field of Classification Search ..... 381/431, 381/415, 412, 395, 152, 420, 421, 422, 407, 381/403, 404, 423, 396
See application file for complete search history.

(56) References Cited

U.S. PATENT DOCUMENTS

| | | | | |
|---|---|---|---|---|
| 2,341,275 | A | 2/1944 | Holland | |
| 3,609,253 | A | 9/1971 | Ashworth | |
| 3,728,497 | A | 4/1973 | Komatsu | |
| 4,017,694 | A * | 4/1977 | King | 381/415 |
| 4,297,537 | A | 10/1981 | Babb | |
| 4,951,270 | A | 8/1990 | Andrews | |
| 5,335,284 | A | 8/1994 | Lemons | |
| 5,335,287 | A | 8/1994 | Athanas | |
| 5,434,458 | A * | 7/1995 | Stuart et al. | 310/13 |
| 5,473,700 | A | 12/1995 | Fenner, Jr. | |
| 6,516,071 | B1 * | 2/2003 | Liu | 381/152 |
| 6,847,139 | B2 * | 1/2005 | Ueda et al. | 310/81 |
| 2005/0185816 | A1 * | 8/2005 | Roark et al. | 381/400 |

* cited by examiner

*Primary Examiner*—Brian Ensey
(74) *Attorney, Agent, or Firm*—Camille L. Urban; G. Brian Pingel

(57) ABSTRACT

The present invention provides an intertial-type voice actuator that includes a magnetic flux conductive material core with a continuous channel. The channel has antifringing groove. The actuator employs a radially polarized cylindrical magnet spaced in the channel to form a magnetic gap and a conductive coil positioned at least partially in the gap. A multi-component suspension system provides high quality sound using an antifriction bearing, a viscous magnetic fluid, and a spider suspension. The inertial-type actuator is completed by an integrated mounting apparatus. In one embodiment, a receiver and an output disk are interlocked by helical wedges and the actuator is mounted on a soundboard. In another embodiment, a special receiving cavity is attached to a wall stud for intrawall installation. The cavity is equipped with longitudinal electrical contacts so that the actuator can move and still be connected. After the actuator is inserted, the wall covering is installed.

34 Claims, 15 Drawing Sheets

INERTIAL VOICE TYPE COIL ACTUATOR

BACKGROUND OF THE INVENTION

1. Field of the Invention

The present invention relates generally to inertial type voice coil actuators capable of converting energy between electrical and mechanical form and, more particularly, to an inertial type voice coil actuator that utilizes radially polarized biasing magnets and a multicomponent suspension for alignment of the moving coil.

2. Description of the Prior Art

Inertial voice coil actuators have been used in the past to acoustically stimulate semi-rigid structures to radiate sound. In this application, voice coil actuators have been attached to structures that are relatively large to act as a soundboard such as a wall in a room, where the wall of the room, when acoustically driven radiates sound. As is well known in the art, the force generated by an electrodynamic transducer is a product of the current, I, length of coil wire, L and flux density, B so that F=iLB. The length of the coil wire that is within the annular magnetic gap is defined as the length, L. This force is what creates the movement of the coil and subsequently generates sound.

These inertial type voice coil transducers are built upon magnetic circuit designs that have classically been used for conventional cone type loudspeakers and not optimized for driving soundboard type structures. These voice coil actuators often require the use of an external housing to support the heavy magnet assembly relative to the voice coil. The voice coil is in communication with the external housing at a location coincident with an acoustic output system that permits the transducer housing to be mechanically attached to a soundboard.

Loudspeaker motors such as used in the past comprise a magnet circuit assembly including a permanent annular magnet, polarized in the axial direction, and sandwiched between two magnetizable plates. One of the plates carries a cylindrical post that extends through a central space defined by the annular magnet, generally referred to as a cylindrical pole piece. The other plate has an annular opening, somewhat larger than the diameter of the pole piece, such that an annular magnetic gap is formed between the post and the inner edge of the associated annular plate. The height of the gap is formed by the thickness of the annular plate having the annular opening.

The basic architecture of the loudspeaker motor design is based upon low magnetic energy magnets, typically comprised of ceramic materials. In order for sufficient magnetic flux to be generated within the annular magnetic gap, the annular magnet must be very large relative to the other components. Some manufacturers have utilized higher energy rare earth based magnets such as Neodymium, but this magnetic architecture is not optimized for the characteristics of these magnets.

Voice coil actuators have a moveable voice coil disposed within the annular magnetic gap. For speakers that use a large body such as a wall to generate sound, the coil has a suspension system that typically utilizes an external housing to which the annular magnet and magnetizable plates are also attached. The external housing provides radial stiffness and axial compliance to the coil. The moving coil has a first end fixedly secured to a radially central portion of the inner surface of the external housing wall. A mounting screw secured to an exterior well portion of the exterior housing may be attached to the wall.

A number of inventions for voice coil actuators have been patented which disclose the aforementioned factors, among them U.S. Pat. No. 2,341,275 to Holland for Sound Reproducing Instrument; U.S. Pat. No. 3,609,253 for Loudspeaker with Improved Voice Coil Suspension; U.S. Pat. No. 3,728,497 to Komatsu for Dynamic Loudspeaker Using Wall as Diaphragm; U.S. Pat. No. 4,297,537 to Babb for Dynamic Loudspeaker; U.S. Pat. No. 4,951,270 for Audio Transducer Apparatus; U.S. Pat. No. 5,335,284 to Lemons for Coneless, No-Moving-Parts Speaker; and U.S. Pat. No. 5,473,700 Fenner, Jr. for High Gain Transducer.

In practice, the annular magnet, magnetizable plates, external housing and structural attachment point comprise a system that is large and heavy relative to the total dynamic force the actuator is capable of generating. If the external housing is mounted on a vertical facing surface e.g. a wall, large bending moments are placed on the structural attachment point and the housing must accommodate these moments without translating them to the coil.

These types of electrodynamic transducers are plagued with well known problems of low power handling, limited frequency response, high levels of sound distortion, substantial size and mass, mechanical complexity and high production costs.

Recent innovations include magnetic materials that have produced magnets with substantially greater magnetic energy than ceramic magnets. These magnets have necessitated the redesign of the magnetic circuit to take advantage of the higher magnetizing flux while reducing the volume of the magnet material consumed, thus reducing its size while simultaneously increasing its force density per unit volume. However, these prior art voice coil actuators are not typically designed with suspension systems adequate for actuators driving relatively large structures such as walls.

U.S. Pat. No. 4,297,537 to Babb for Dynamic Loudspeaker describes an antifriction bearing which adjoins the voice coil and slidably moves on the cylindrical pole piece providing high radial stiffness and essentially infinite compliance in the axial motion of the voice coil. This patent describes a magnetic circuit with an annular magnet where the voice coil is driving a conventional cone speaker. It does not utilize a large body for sound generation nor is it designed to be vertically mounted.

U.S. Pat. No. 5,335,287 to Lewis for Loudspeaker Utilizing Magnetic Liquid Suspension of the Voice Coil discloses a method of using a viscous magnetic fluid suspension for the voice coil in lieu of a corrugated disk suspension. However, use of such fluid can result in internal pressure build-ups or subatmospheric conditions within the magnetic gaps. U.S. Pat. No. 5,335,287 solves that problem by including a fairly sophisticated venting system, however, the system is expensive to manufacture and the speaker disclosed is of the traditional cone type without adaptation to large sound bodies. No means is provided to minimize flux leakage.

Increasingly, high fidelity audio recordings are being made where the upper frequency range is over one (1) octave higher than normal human hearing at 20 kHz. Accurate reproduction of these frequencies is often not addressed or is only poorly accomplished by earlier speaker systems.

It is therefore an object of the present invention to provide a novel voice coil actuator with a high force density. It is a second object of the present invention to minimize flux leakage while providing a smaller and more efficient device for driving relatively large structures. A third objective of the invention is to minimize sound distortion by providing a multi component voice coil suspension system. A fourth objective of the invention is to provide an inertial voice coil actuator equipped with a simple mounting system for transducing sound to a soundboard.

A fifth objective is to provide an inertial voice coil actuator equipped with means to quickly and removably affix the voice coil actuator to various surfaces without the use of adhesive bonding between the output disk and the soundboard and without the need for tools thereby minimizing assembly and repair time.

A sixth objective is to provide an inertial voice coil actuator that may be installed intra-wall without loss in sound quality.

It is another object of the present invention to further provide a means to couple the voice coil actuator with a soundboard utilizing controlled pressure where the voice coil actuator is not exposed, but is installed within a wall.

Yet another object is to provide a method of enhancing the system for extended high frequency response.

It is further a feature of the present invention to provide means to supply a signal and current to the voice coil actuator through a retainer where contacts are configured to maintain their electrical connection even with slight axial translation of the voice coil actuator.

It is a final feature of the present invention to govern the placement of the voice coil actuator between the vertical studs of a wall in order to diminish resonate frequencies of the soundboard.

SUMMARY OF THE INVENTION

According to the present invention, the novel voice coil actuator includes a magnetic flux conductive material core, a magnet, and an electrical current conductive coil uniquely arranged. The core has a first surface and a continuous channel disposed in said first surface. The channel has a pair of opposing walls. The magnet is radially polarized and disposed in intimate contact with either one of the channel walls and spaced from the opposing channel wall so that a gap remains between the magnet and the opposing wall. The magnet has two faces of opposite magnetic polarities; one faces the gap. The magnet is further spaced from the bottom of the channel so that magnetic flux is substantially normal from the face across said gap to the wall. The electrical current conductive coil is disposed around a coil former and moveably positioned in the gap such that an electrical current in the coil develops a magnetic force on the coil in a direction substantially normal to the magnetic flux to displace the coil in response to the magnetic force.

A feature of the present invention is the unique arrangement of the components. One pole or face of the magnet is adjacent the gap. This construction ensures that the magnetic flux will be uniformly distributed substantially along the length of the gap since the flux emanating from the face is inherently substantially uniform. The spacing of the magnet from the bottom of the channel also ensures that leakage flux is minimized since the flux will follow the path of least resistance and will prefer to be confined through the core and gap. The minimizing of leakage obviates the need for bulky shielding which allows for simpler, lighter and smaller packaging than existing actuators.

A second feature according to the present invention is a multi-component suspension system that supports the electrical current conductive coil in such a manner that the coil has high radial stiffness along with appropriate axial compliance. The electrical current conductive coil is wound on the coil former that is typically formed of polymeric material to form a cylindrical shaped object. The coil former has a first portion that is external to the magnetic gap and suspended by a disk shaped member known as a spider suspension that provides radial stiffness while providing a restoring force to an axial displacement. The spider suspension of the first embodiment includes a concentric corrugation that provides additional compliance in the axial direction. The compliance of this spider suspension is tuned to first resonant frequency that is below the low pass ($f_o$) frequency of the signal sent to the inertial type voice coil actuator. In addition the suspension provides sufficient stiffness to support the mass of the magnetic circuit in a vertical orientation without displacing the voice coil from neutral position more that 10% of its total axial displacement. A second embodiment includes a second spider suspension spaced vertically from the first, having the same general configuration as the first suspension.

The spider suspension has an annular opening that is sized to the outer diameter of the voice coil former. The spider has an outer diameter that is mechanically attached to a surface of the core. The spider suspension system in a preferred embodiment is formed of an elastic or visco-elastic material such as polyurethane, polypropylene, or other polymeric material. More than one spider may be used for added suspension control.

A second portion of the coil former is internal to the gap and a viscous magnetic fluid suspension and an antifriction bearing suspend the second portion. The viscous magnetic fluid suspension is a fluid that fills any space between the inner and outer surfaces of the voice coil former, the coil, the face of the magnet, and the wall of the channel. The viscous magnetic fluid prevents the voice coil from rubbing or striking the wall of the channel or the face of the magnet. The suspension system also comprises an antifriction bearing surface disposed in intimate contact with one wall of the channel to support the surface of voice coil former. The antifriction bearing is sized to provide sufficient clearance for the voice coil former, but in the event of a large radial force, it prevents the voice coil from striking or rubbing the wall of the channel or the face of the magnet. This bearing also provides a spring of infinite compliance along the axial length of the electrical current conductive coil.

In the preferred embodiment, the magnetic fluid is a low viscosity oil, having microscopic ferrous particles such as magnetite, homogeneously suspended in the fluid. The oil-magnetic emulsion is attracted to and held in the magnetic field within the magnetic gap by reason of the magnetic flux across this gap. The magnetic particles hold the liquid phase of the oil within the gap. The viscous magnetic fluid provides a heat dissipating mechanism and a radial restoring force when the voice coil is radially displaced. The restoring force is a result of an unbalanced magnetic force in the fluid when the fluid is not symmetrically displaced within the magnetic gap and coil former. The radial restoring force is typically sufficient to support the mass of the magnetic circuit when its axis is parallel to a horizontal orientation. In the event of substantially larger radial forces that will overcome the radial restoring force of the viscous magnetic fluid, the antifriction bearing acts as a back-up bearing for the voice coil former.

A third feature of the present invention includes a unique integrated mounting apparatus providing both quick installation and quick removal features. The mounting apparatus transduces vibrations through the coil to the soundboard through an output disk. In a preferred embodiment the integrating mounting apparatus comprises the output disk acoustically associated with the soundboard and the coil former.

Another preferred embodiment includes an integrating mounting apparatus comprising the output disk and a receiver designed to interlock one with the other in such a way as to accurately translate the vibrations without attenuation or distortion to a sound body. One way of accomplishing these objectives uses an interlocking mechanism which comprises at least one helically arranged wedge on the output disk and at least one complementary engagement opening on the receiver. In operation, the wedges on the output disk are positioned to be in communication with a base formed in the receiver thereby providing accurate transmission of vibrations. In the preferred embodiment the output disk further registers into the receiver rotationally via pins, tabs or other registration means which assist in placement of the engagement wedge on the wall of the receiver. The output disk can then be rotated and pressured into the receiver. There is a locking means that will hold the output disk in its downward pressured position against the receiver in order to accurately transmit vibrations and forces created by the voice coil actuator to the receiver, and then through the receiver to the substrate or soundboard.

To evenly distribute the downward pressure forces between the output disk and the receiver exerted by the helical interface, the distal surface of the output disk can be molded with a very slight convexity. When pressured into the receiver by the helical means on the output disk, the output disk would compress downward, flattening the convexity of the outer surface rendering it flat and causing even forces to propagate throughout the surface.

Adhesive or conventional fixative means are used to acoustically couple the receiver and the soundboard. No adhesives between the output disk and receiver are necessary. This mounting arrangement is particularly useful when the voice coil actuator is to remain exposed and minimizes the need for tools and time for assembly, installation, and repair.

The unique integrated mounting apparatus in yet another embodiment preferably provides a means to affix the voice coil actuator in a way that will result in an intra-wall sound transducer rather than an exposed sound transducer. Here, means to affix said voice coil actuator must create a controlled contact force between the output disk and the soundboard. This is accomplished by using a retainer that can itself be affixed mechanically, adhered or otherwise in communication with the infrastructure of the wall and providing means to pressure said voice coil actuator into a receiving cavity in the retainer. The retainer is registered and affixed via registering means to one of the vertical stud members of a standard wall construction. The receiving cavity is provided means by which to guide the insertion of the voice actuator. A contact protrusion on the voice coil actuator includes electrical contacts and a contact opening in the retainer includes at least one sprung electrical contact with which the voice coil electrical contact is slidably engaged. The contacts are configured to maintain their electrical connection even with slight axial translation of the voice coil actuator.

Preferably, a perimeter ring forms part of the receiver. The output disk is seated by the perimeter ring which pushes the output disk out beyond a register with the retainer. When wall cladding, such as drywall, is added, means to associate the output disk with the drywall ensure that the drywall presses the output disk and, in turn, the perimeter ring, producing the desired controlled contact force. The receiving cavity of the retainer holds the voice coil actuator in a precise axial orientation normal to the drywall surface. A small space allowance within the axial orientation of the voice coil actuator between the voice coil actuator and retention means permits small axial movements of the voice coil actuator to be unimpeded. A loose, frictionally triggered snap is the preferred means of retention.

For intrawall installations, the placement of the voice coil actuator between the studs of a wall can improve sound quality. In order to diminish resonate frequencies, the distance from the center axis of the receiving cavity of the retainer and the stud registering surfaces of the retainer are such that the voice coil actuator is placed inboard of the intra-stud center point to diminish resonate frequencies of the substrate.

In order to accurately reproduce the extended frequency response of the system, a high frequency speaker element may be mounted in near proximity to the inertial voice coil actuator assembly. These high frequency speaker elements can be comprised of any electro-dynamic, piezo-electric, or magnetostrictive type systems.

In one configuration providing extended frequency response, the integrated mounting apparatus includes the output disk which comprises an annular opening. A high frequency speaker element is co-axially located with the output disk of the voice coil actuator opposite the voice coil actuator assembly and mounted in such a manner that the acoustic output of the high frequency speaker element is directed away from the side on which the inertial type voice coil actuator is mounted. The output disk may be mechanically or adhesively affixed to the soundboard.

The high frequency speaker element is electrically connected with the inertial type voice coil actuator so that the high frequency components of the audio signal are preferentially sent to the high frequency speaker while limiting the low frequency components to the inertial type voice coil actuator.

Another embodiment of the inertial type voice coil actuator with extended high frequency speaker system uses a plurality of high frequency speaker elements configured in a spatial array. The spatial array can be configured in any single, two or three-dimensional geometry.

The present invention provides a voice coil actuator with superior suspension system and novel construction, which results in a lighter and smaller package, more accurate sound reproduction, and faster, simpler installation for use with large or small soundboards.

Other objects, features, and advantages of the present invention will be readily appreciated as the same becomes better understood after reading the subsequent description taken in conjunction with the appendant drawings.

DETAILED DESCRIPTION OF THE PREFERRED EMBODIMENT

Figure 1:
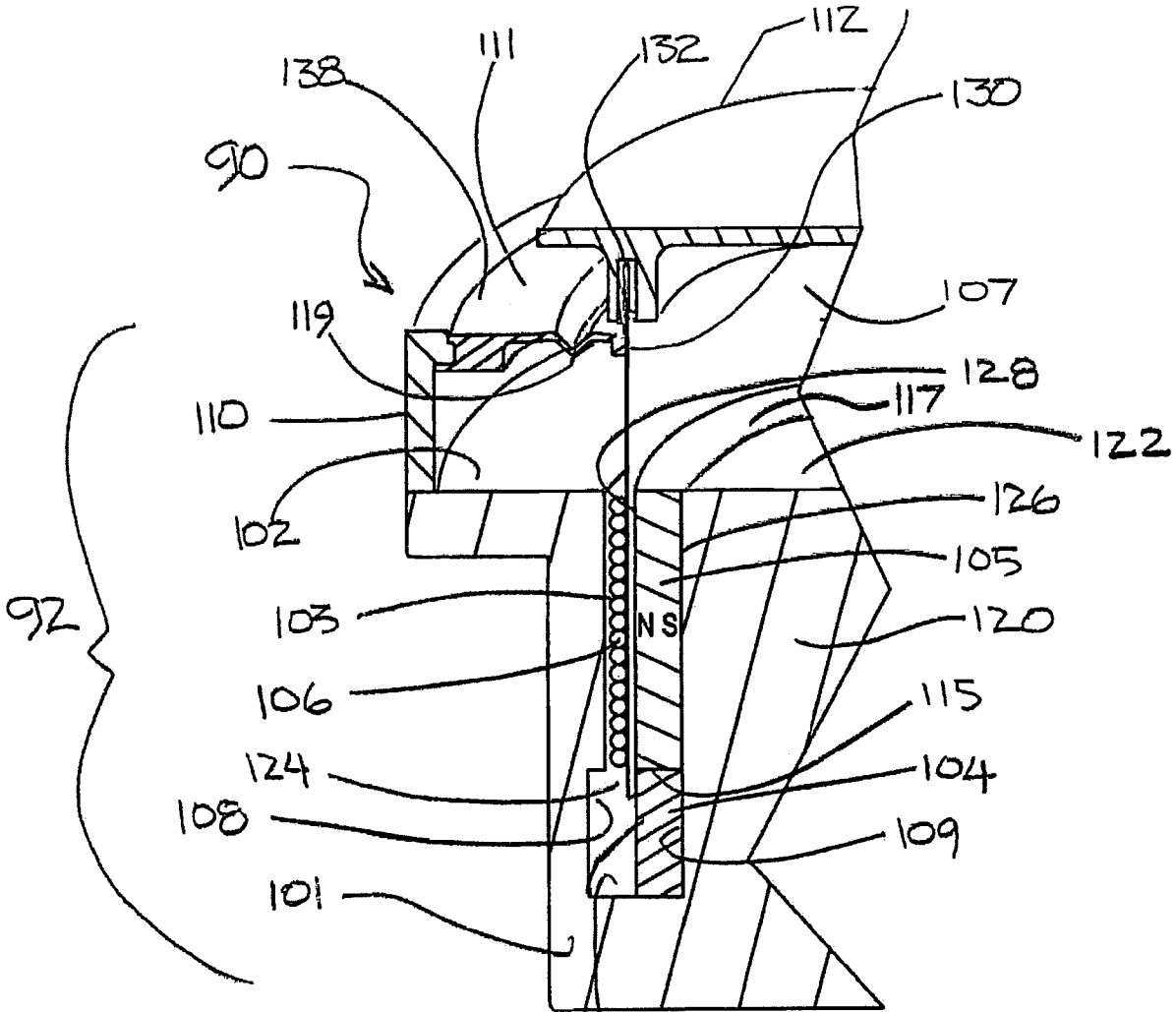
FIG. 1 is a perspective view of the present invention as installed on a large sound body.
Figure 2:
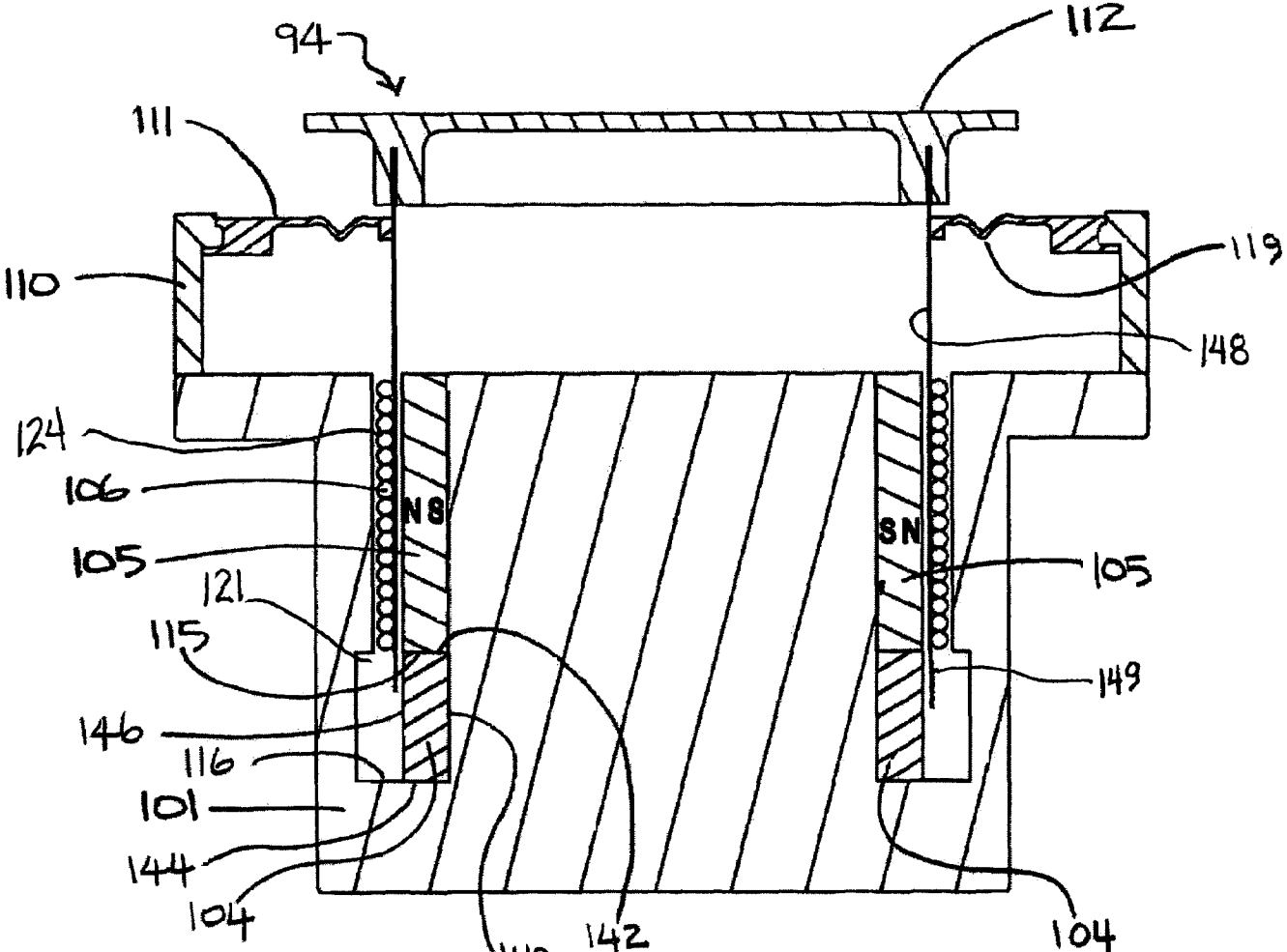
FIG. 2. is a fragmentary cross-sectional perspective view along line 2-2 on FIG. 1 of the Inertial Type Voice Coil Actuator of the present invention showing its suspension system and construction.

Referring now to FIGS. 1-2, there is shown a novel inertial type voice coil actuator constructed according to the principles of the present invention. A voice coil actuator assembly 90 includes a core 101, a magnet 105, an electrical current conductive coil 106, and a multi-component suspension system 92 comprising a coil former 107, an antifriction bearing 104, a spider suspension 111, and a spacer 110. The core 101 is constructed from magnetic flux conductive material and has a first surface 102 and a continuous channel 103 disposed in the first surface 102 which leaves a center column 120 with a top surface 122. The channel has a first wall 108, a second opposing wall 109, a bottom wall 116 and an anti-fringing groove 121. An integrated mounting apparatus 94 of a preferred embodiment of the voice coil actuator comprises an output disk 112 (see FIGS. 1, 2 and 3). The integrated mounting apparatus of another embodiment includes an output disk 247 and a receiver 114 with means for interlocking said output disk and said receiver (see FIGS. 4-6*a*). Another embodiment uses an integrated mounting apparatus comprising the output disk 112 and a retainer 200 (see FIGS. 7-13). A final embodiment includes an output disk 112 having an annular hole 310 as the integrated mounting apparatus (see FIGS. 14 and 15).

The magnet 105 is disposed in intimate contact with the second wall 109 so that a magnetic gap 124 is formed between the magnet and the first wall 108. (See FIG. 2) The magnet 105 is cylindrical in shape, is of radial polarization, and comprises a first face 126 of a first magnetic polarity and a second face 128 of a second polarity. The first face 126 is adjacent the second wall 109 and the second face 128 is disposed within the gap 124. The magnet 105 has a lower edge 115 spaced from the bottom wall 116 of the channel 103 forming an anti-fringing groove 121 and an upper edge 117 coextensive with the top surface 122 of the center column 120. It should be understood that magnet 105 may be disposed on either first wall 108 or second wall 109. A higher performance design of the present invention will have the magnet 105 disposed on the outer first wall 108 of the channel 103. This alternative arrangement creates a stronger magnetic flux across the gap, thus improving its force output for a given current.

Shown best in FIG. 2, the coil 106 is moveably suspended in said gap 124 such that an electrical current in the coil 106 develops a magnetic force on the coil 106 in a direction substantially normal to the radial magnetic flux caused by magnet 105 to displace the coil 106 in response to such magnetic force. Of course, when the coil 106 is coaxially suspended in the gap, the force will be axial and linearly proportional to the current, as is well known.

The coil 106 is wound on the coil former 107 that is used to mechanically couple the electro-magnetic force between the magnetic flux from the permanent magnet to the output disk 112. The suspension of the coil former 107 in the present invention is designed to maintain radial alignment of the coil 106 within the gap 124 without causing sound distortion. This suspension system 92 prevents the coil 106 from striking or rubbing against the wall 108 of the channel 103 or the second face 128 of the magnet while still allowing axial compliance.

Figure 3:
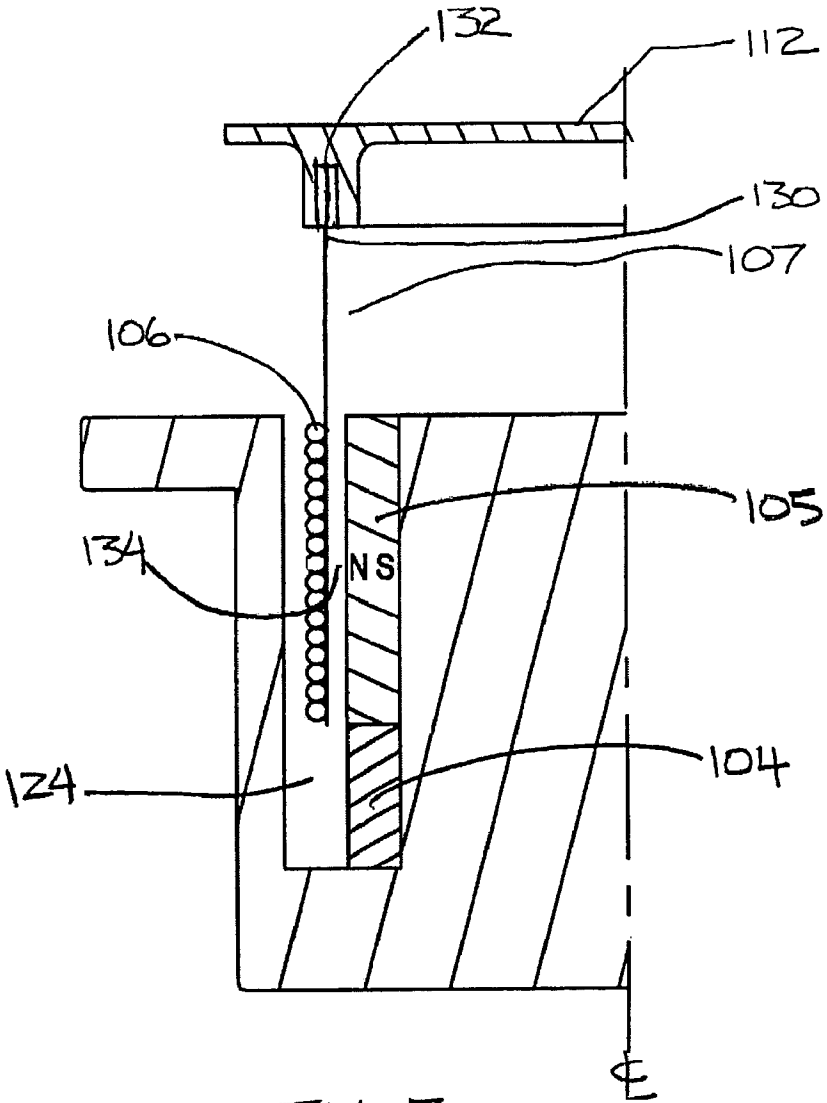
FIG. 3 is a cross sectional view along line 3-3 of FIG. 1 of the Inertial Type Voice Coil Actuator of the present invention including an acoustic mechanical interface between the output disk and receiver of the present invention.

Referring now to FIGS. 1-3, the suspension system 92 comprises the coil former 107, a first portion 130 of the coil former 107, the spider 111 with a concentric corrugation 119, the spacer 110, a groove 132 in the output disk 112, a viscous magnetic fluid 134, and the antifriction bearing 104. The first portion 130 of the coil former is radially suspended by the spider 111 which is disk shaped in the preferred embodiment. The spider 111 may contain a concentric corrugation 119 that provides additional compliance by the coil former 107 in the axial direction. The concentric corrugation 119 will also permit additional axial displacement. This additional displacement is required for improving the low frequency response, or alternatively increased sound pressure level. The spacer ring 110 comprises means for attaching a distal portion 138 of the spider suspension 111. Means for attaching the distal portion 138 of the spider 111 to the spacer 110 can be through overmolding, ultrasonic welding or other bonding or mechanical methods.

The antifriction bearing 104 has a first face 140 in intimate contact with the second wall 109 of the gap 124. An upper surface 142 of the bearing 104 is in intimate contact with the lower edge 115 of the permanent magnet 105 and a lower surface 144 is in contact with the bottom wall 116 of the channel 103. A second face 146 of the bearing 104 is facing a first inner surface 148 of the coil former 107. The bearing 104 of the preferred embodiment is made from a low friction material such as Teflon® by DuPont or similar material.

The acoustic output of the present invention is to the output disk 112 and best shown in FIGS. 2 and 3. The output disk 112 comprises a groove 132 in which the coil former 107 is bonded. The output disk 112 serves to stabilize the thin wall coil former from transverse radial forces between the coil former 107 and the output disk 112. The output disk 112 is a lightweight component to preferentially increase the velocity of the output disk 112 relative to the core 101 based on the relative mass. The output disk 112 may be attached mechanically or adhesively to a soundboard.

As best seen in FIG. 3 a second portion 149 of the coil former 107 is radially suspended by the viscous magnetic fluid 134. The magnetic fluid 134 is held in suspension by the resulting magnetic flux from the permanent magnet 105. The magnetic fluid will provide a radial restoring force if the coil former 107 is radially displaced in the magnetic gap 124. The antifriction bearing 104 is provided for the coil 106 to land upon if a large radial force is imparted to the coil former 107 causing large radial displacements. The bearing 104 will prevent the coil former 107 from striking or rubbing the magnet 105 or the outer wall 108 of the channel 103.

Figure 4:
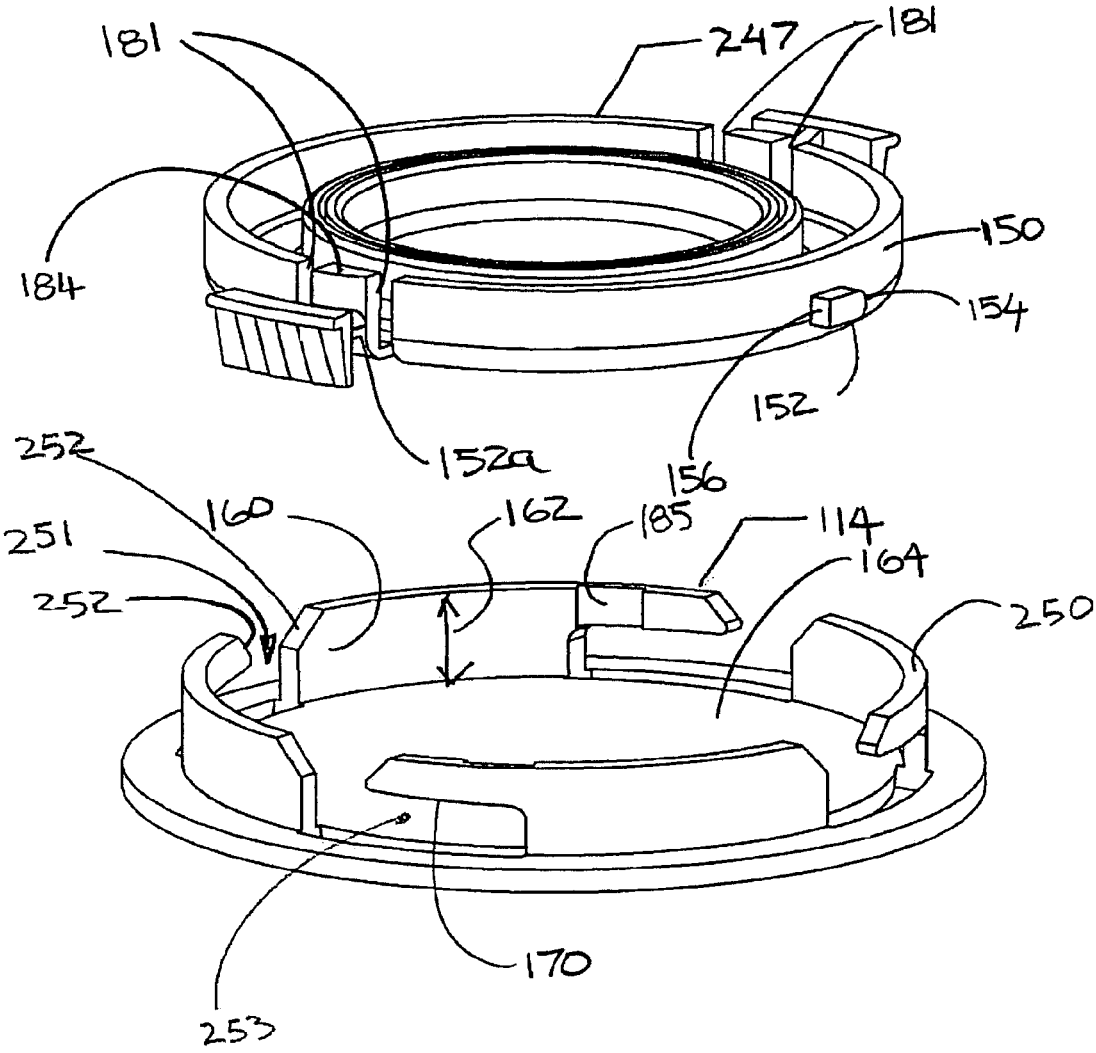
FIG. 4 is an exploded perspective view of a second embodiment showing the output disk and a receiver with interlocking elements of the present invention.
Figure 5:
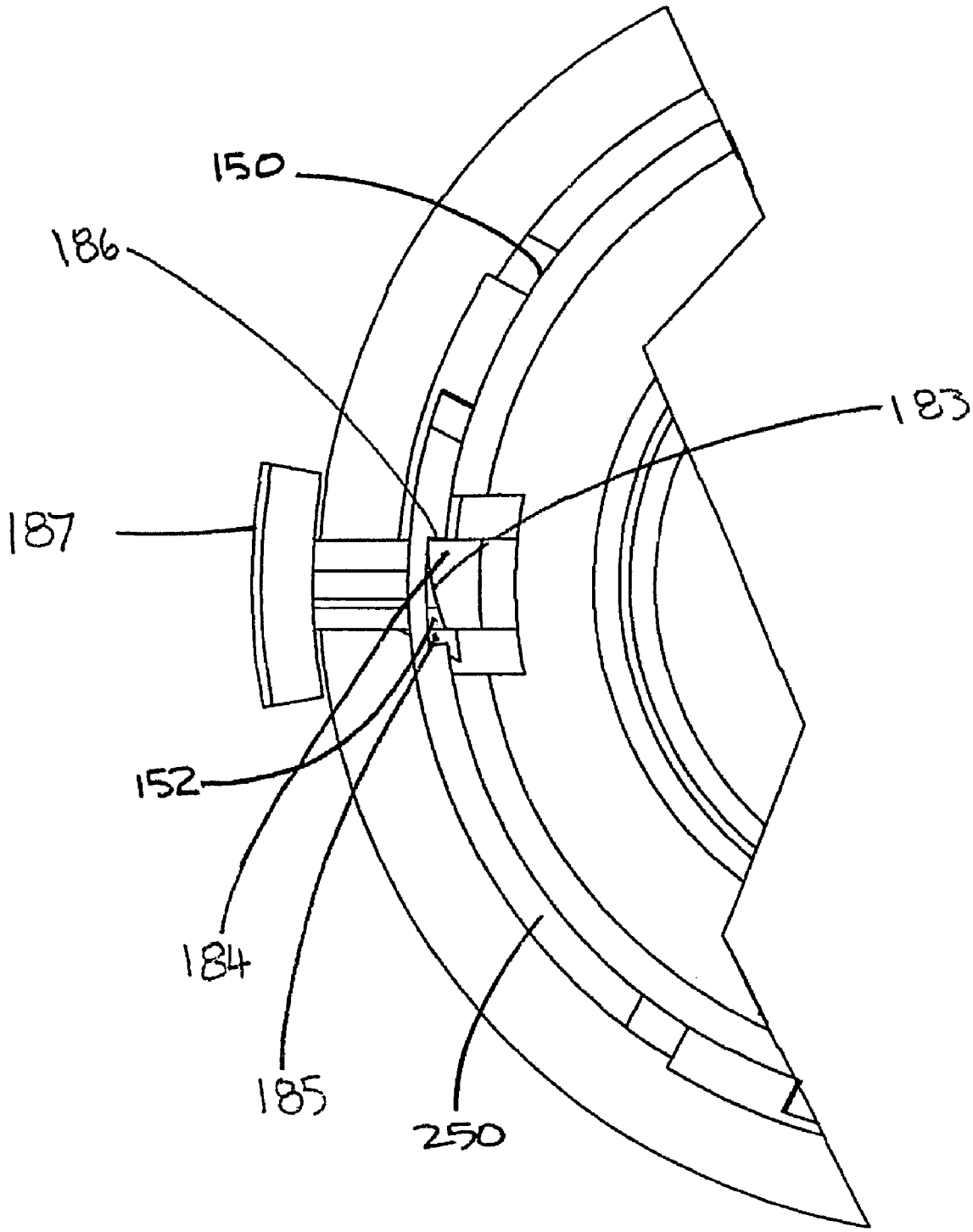
FIG. 5 is a top view of the locking portions of the receiver and output disk elements of the second embodiment.
Figure 6:
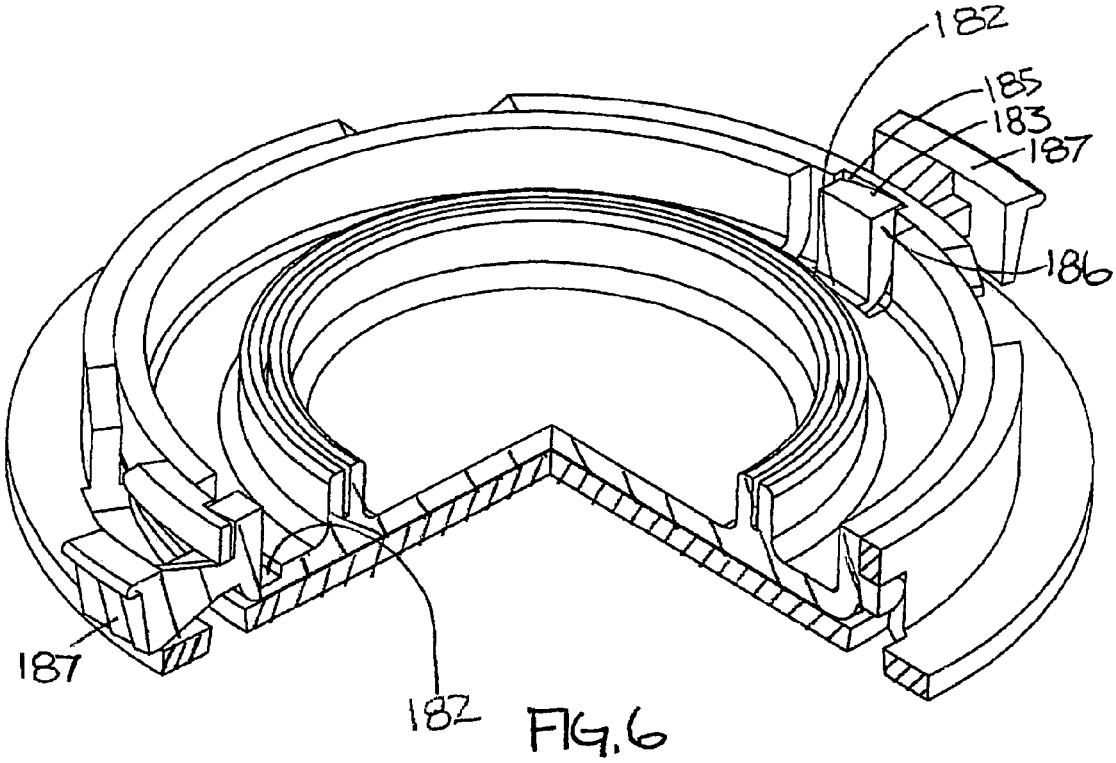
FIG. 6 is a cut away perspective view of the receiver and output disk interlocked, particularly showing the interlocking elements of the second embodiment.

FIGS. 4, 5 and 6 depict an integrated mounting apparatus of another embodiment. The output disk 247 and its receiver 114 and means for interlocking them are shown. In the preferred embodiment, there is a distal surface 150 of the output disk 247 on which are at least one and preferably a plurality of segmented helical wedges 152 and 152*a*. Each of said plurality of segmented helical wedges 152 tapers from a first leading edge 154 to a second trailing edge 156. In the preferred embodiment, each segmented wedge 152 is generally spaced equidistant from other segmented wedges.

The receiver 114 of this preferred embodiment has an annular hole 160 with a depth 162 and a base 164. A protruding segmented wall 250 is characterized by at least one and preferably a plurality of openings 251. The openings 251 are flanked by angled receiving surfaces 252 which ease accurate placement of said segmented helical wedges 152. Each of said plurality of openings 251 comprises an adjacent helicoidal opening 253 with a surface 170 complementarily shaped to the segmented helical wedges 152.

Figure 6A:
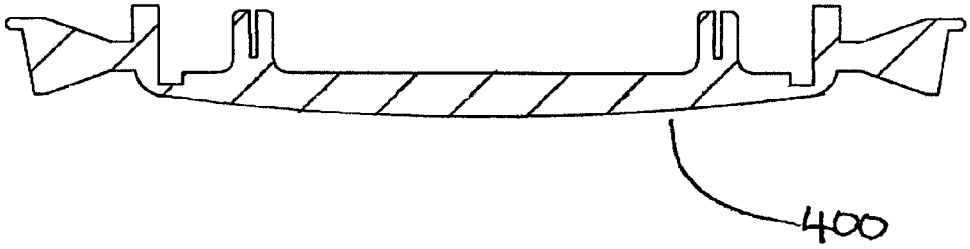
FIG. 6*a* is a cross section of the output disk along line 6-6 showing a convex surface.

For installation, the receiver 114 is mounted on a soundboard by conventional means. The wedges on the output disk 247 on the voice coil actuator 90 are then aligned with the openings 251 on the receiver. The voice coil actuator is moved toward the receiver 114 such that the engagement wedges are in a position to rotationally engage helicoidal openings 253 and the surfaces 170. Next, the voice coil actuator assembly 90 is rotated a partial turn which frictionally engages the receiver 114 and the output disk 247 and serves to transmit sound vibrations as well as mount the unit on the sound body. To evenly distribute the downward pressure forces between the output disk 247 and the receiver 114, the distal surface 400 of the output disk can be convex as shown in FIG. 6*a*. As the output disk is compressed downward during installation, the convexity will flatten and disperse the downward forces more evenly.

In this preferred embodiment the output disk is removably engaged to the receiver 114 using the wedges 152. As shown in FIGS. 5 and 6 in order to secure the position of the voice coil actuator and to maintain positive contact between the output disk 247 and the receiver 114, a locking means comprising a locking snap wedge 184 which forms part of distal surface 150 is employed to prevent the output disk from counter rotating and diminishing contact pressure between the output disk 247 and said receiver 114. The locking snap wedge 184 bears a curved sloped wedge surface 183 which when engagably rotated into receiver 114 will deflect inward until said locking snap wedge 184 attains a recess 185 in the protruding segmented wall 250 At this point the locking snap wedge 184 finds relief to the inward deflection and springs into the recess 185 where a locking surface 186 engages said wall 250 which prevents the output disk from counter rotating. As shown in FIG. 6 and FIG. 4, at least one wedge 152*a* and preferably two wedges 152*a* arranged in opposition, are hinged by way of dedicated flexural hinges 182 associated with said distal surface 150 and openings 181 in said distal surface 150 of said output disk which permit inward deflection of the locking snap wedge 184. To facilitate disengaging the voice coil actuator assembly 90, release tabs 187 are provided in an opposed position. Compressing release tabs 187 deflect the portion of the distal surface 150 between the openings 181 and cause the locking snap wedges 184 to deflect inward disengaging the locking snap wedges 184 and permitting counter rotation of the voice coil actuator 90 for easy removal.

Figure 7:
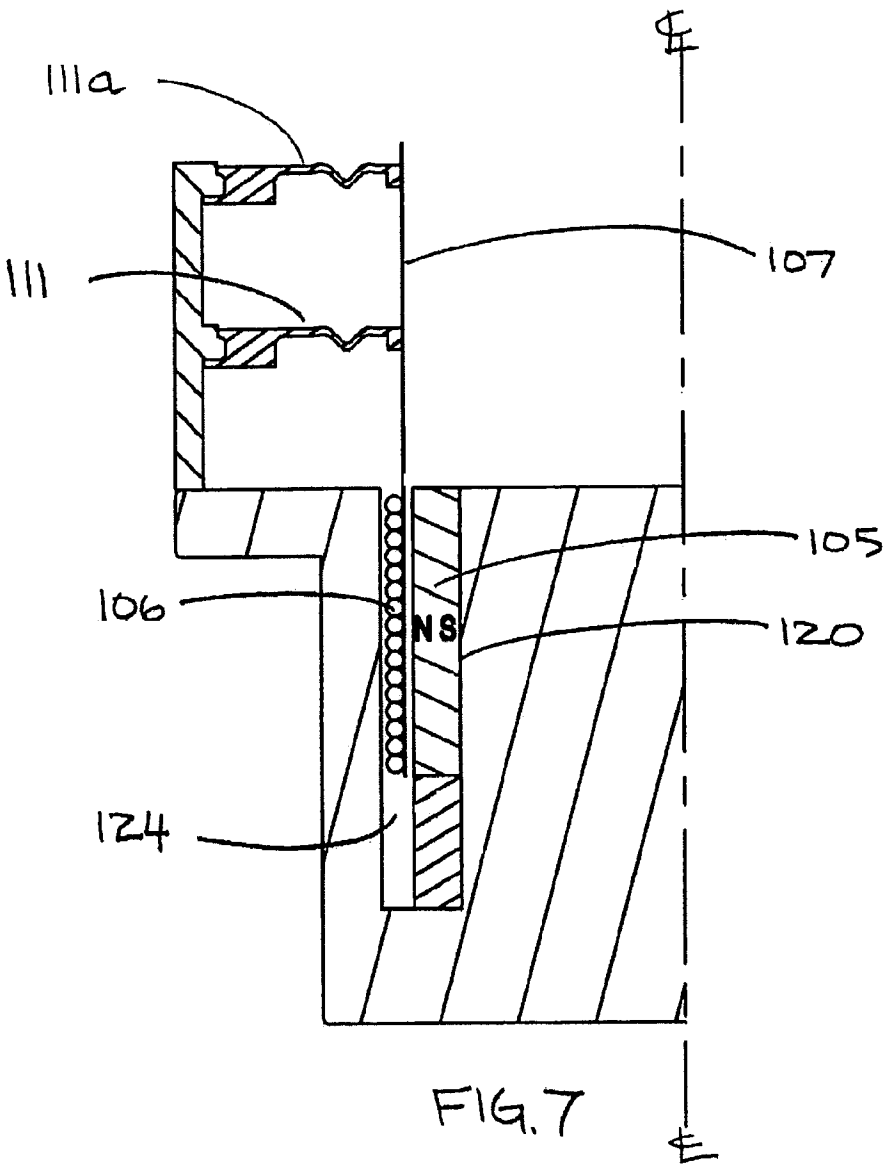
FIG. 7 is a cross sectional view of a third embodiment of the present invention wherein an additional element in the suspension system is shown.

An alternative coil former suspension is shown in FIG. 7. The electrical current conductive coil 106 is wound on a coil former 107 that mechanically couples the electro-dynamic force into the desired acoustic structure. The coil former 107 in this configuration uses multiple spider suspension 111 and 111*a* elements to radially align the coil former 107 with the magnetic gap 124. The spider elements permit axial displacement of the coil former 107 while restricting rocking motion or other out of plane motions that will cause the coil former 107 to strike or rub the permanent magnet 105 or the outer wall 108 of the channel 103.

Figure 8:
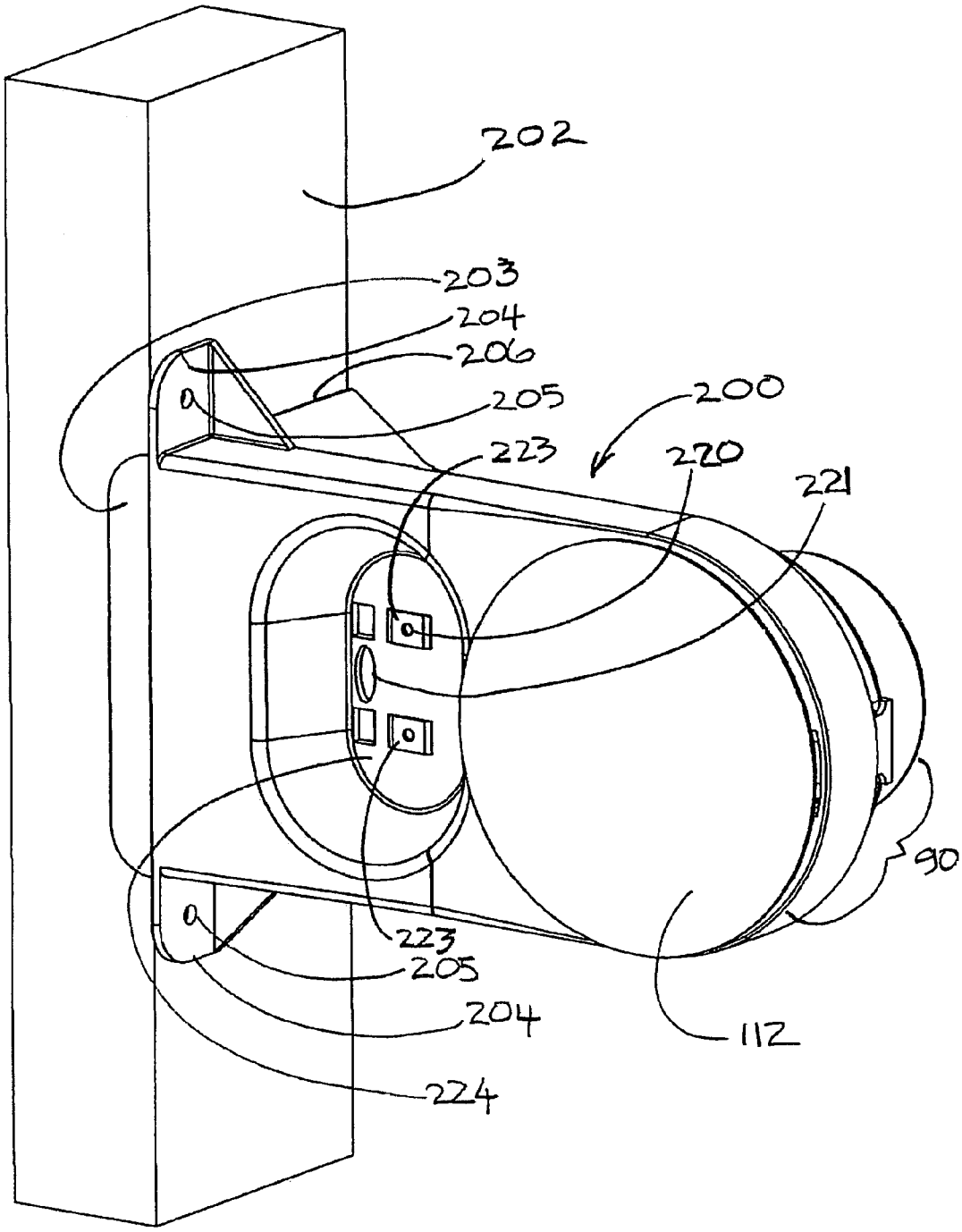
FIG. 8 is a perspective view of the third embodiment installed on a wall stud member.

The inertial type voice coil actuator of the present invention will often be used in conjunction with a drywall type soundboard. Typical wall construction technology is considered in a modification of the preferred embodiment wherein said integrated mounting apparatus comprises a voice coil actuator retainer 200 and said output disk 112 as shown in FIG. 8. The retainer 200 is used to affix the voice coil actuator to wall cladding. In order to affix the voice coil actuator to a soundboard where standard wall construction methods are considered, the voice coil actuator assembly 90 with its output disk 112 is coupled with retainer 200 which, in turn, is provided means for affixing to a wall stud 202. Said means for affixing comprises a front depth registration means 203 referencing the surface of the stud 202 to which wall cladding will be applied, a brace 206, at least one securing tab 204, and at least one hole 205. Once registered using these surfaces, the retainer 200 is secured using screws or other mechanical means and as shown in the preferred embodiment by way of said at least one securement tab 204 which is used in conjunction with said at least one hole 205 to screw or otherwise firmly affix retainer 200 to the wall stud 202. It should be noted that each said at least one hole 205 is in a position where it is easily accessed in order to facilitate the installation of the retainer 200.

Figure 9:
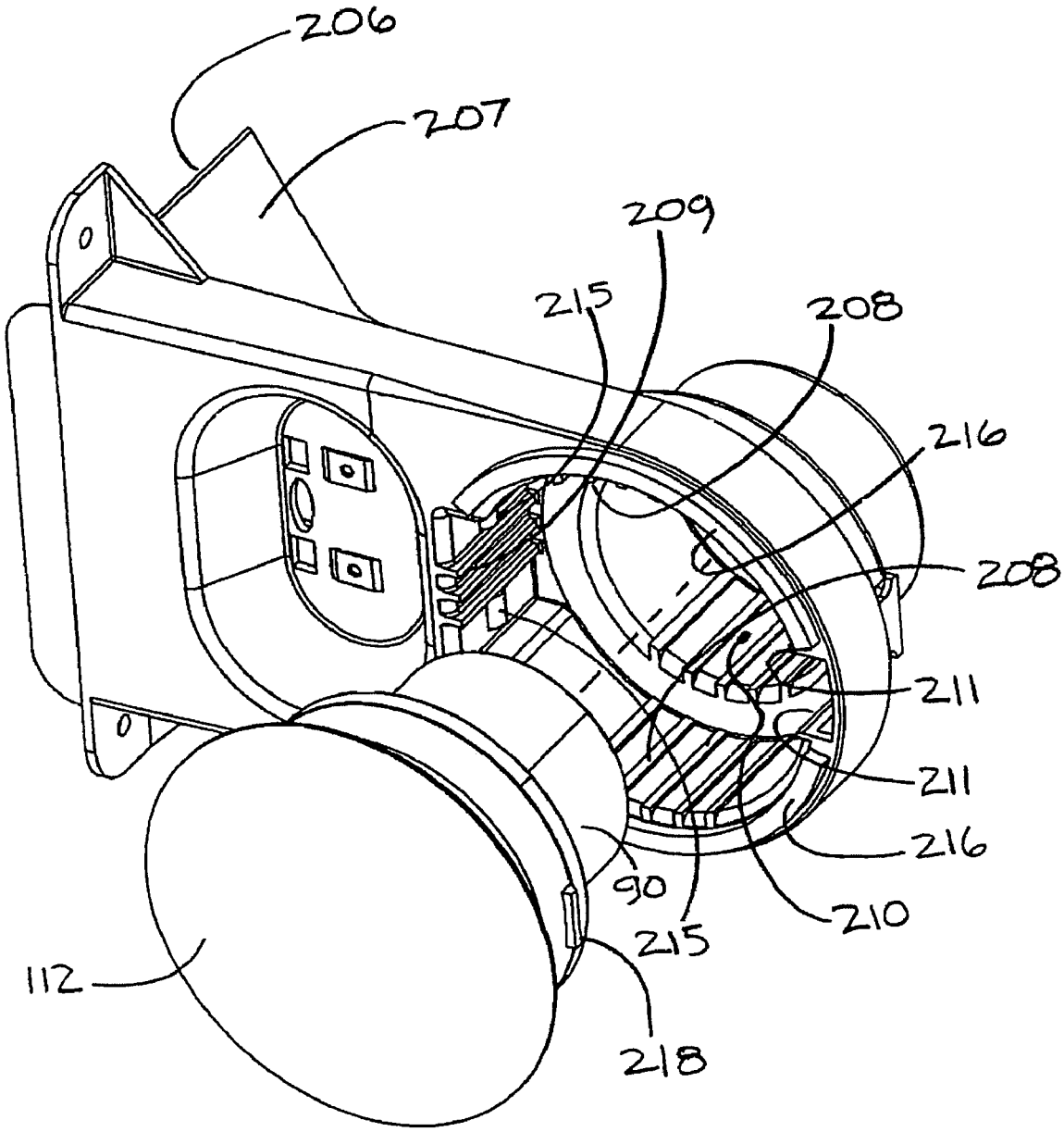
FIG. 9 is an exploded perspective view of the third embodiment showing the retainer element, particularly showing certain features of the receiving cavity of the retainer.
Figure 10:
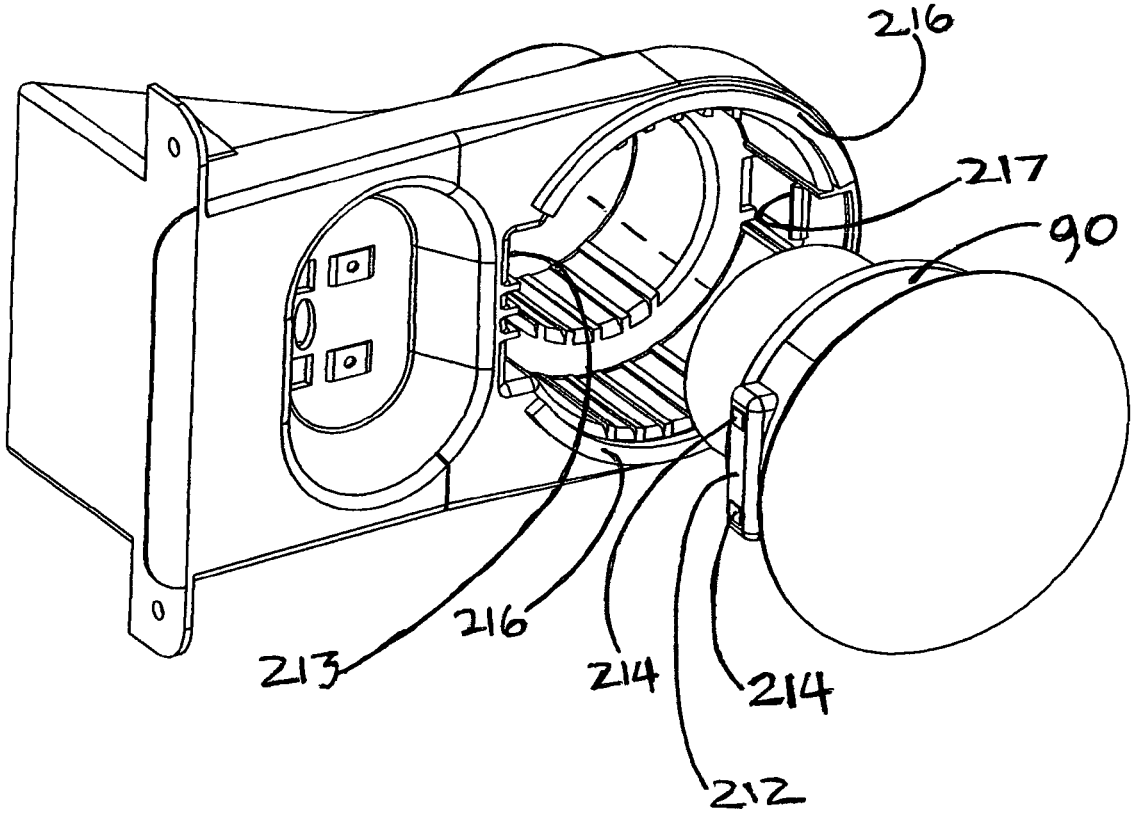
FIG. 10 is an exploded perspective view of the third embodiment, particularly showing certain other features of the receiving cavity of the retainer.
Figure 11:
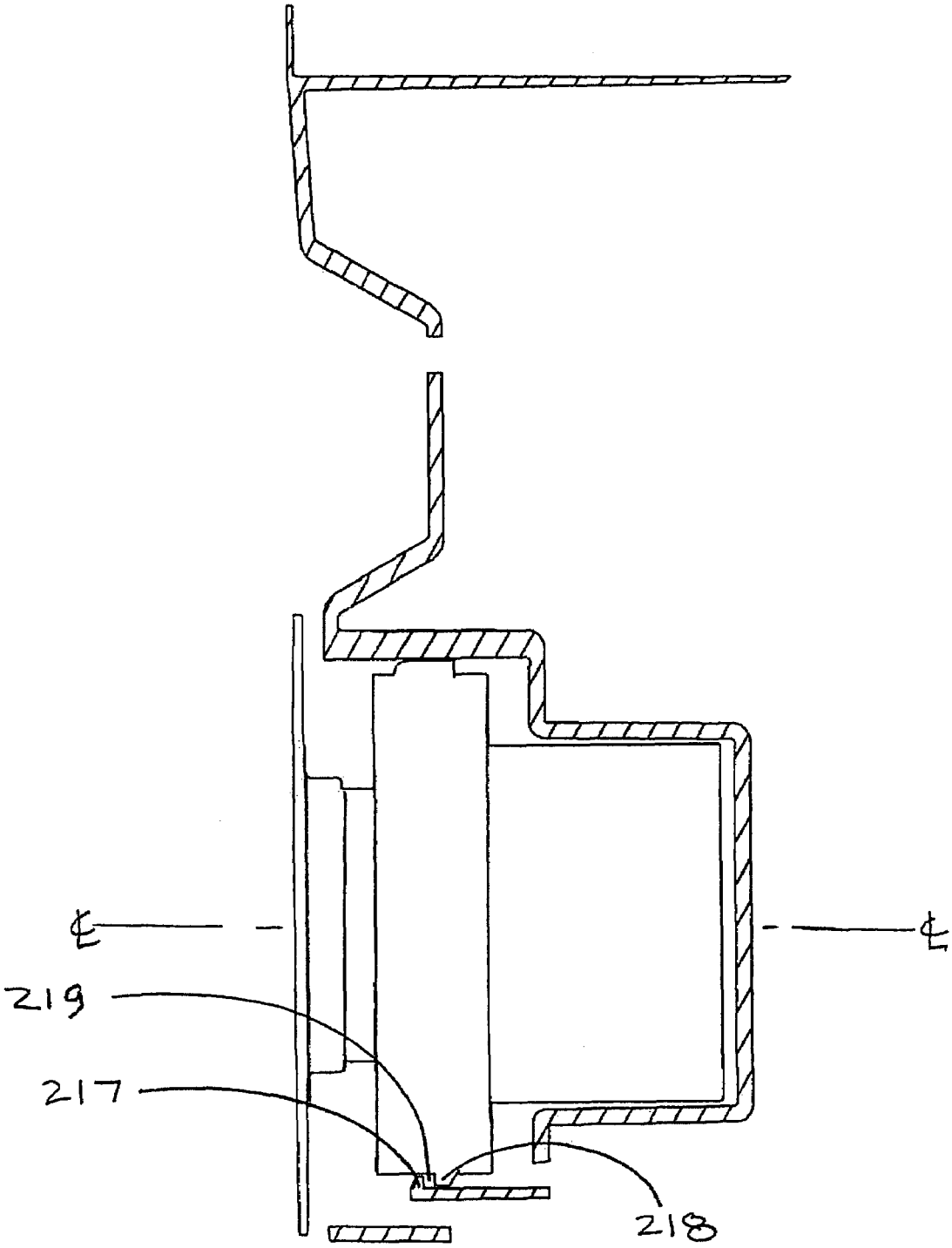
FIG. 11 is a cut away view of the retainer element at the height of a retention means on the retainer element of the preferred embodiment.

This third embodiment as shown in FIGS. 8-13 gives full consideration to the sequencing used in standard wall construction, whereby the retainer 200 is mounted to stud member 202 after the wall framing is fabricated. Once retainer 200 is affixed, voice coil actuator assembly 90 is inserted into retainer 200 following the center axis of the voice coil actuator assembly 90 as shown in FIG. 9 and FIG. 10. Receiving means 210 is included to secure said voice coil actuator assembly. Said means 210 may be as simple as a "c" opening in which said actuator is placed. Receiving means 210 as shown in FIGS. 8-13 comprises a receiving cavity, a plurality of horizontal rib guides 209 and 211, as well as vertical ribs 208. Said voice coil actuator further comprises at least one electrical contact 214. Said retainer 200 further comprises at least one sprung electrical contact 215. As the voice coil actuator is inserted into receiving cavity 210, it is slidably guided by horizontal rib guides 209 and 211, as well as vertical ribs 208 which are essentially concentric with the external surface of voice coil actuator assembly 90. The rotational orientation of the voice coil actuator assembly 90 is governed by co-locating registration means such that said contacts 214 and 215 are in electrical communication. Preferably, said co-locating means comprises a contact protrusion 212 on said voice coil actuator, which nests with a contact protrusion opening 213 on the retainer 200. Voice coil electrical contacts 214 are guided in place to come in contact with said at least one sprung electrical contacts 215. The semi circular form of the sprung contacts 215 provides a brushing contact means with voice coil actuator contacts 214.

The voice coil actuator may be affixed to the wall using an adhesive on the output disk 112. The voice coil structure must be free to move axially so as to generate fore aft energy impulses. The electrical contact means 214 and 215 as described, permits free fore aft movement of the voice coil actuator while maintaining constant electrical contact. The voice coil actuator assembly 90 acts as a cassette when inserted into the receiving cavity 210 providing ease of installation and removal. Electrical contact is made automatically and independently of the installer. It should be noted that the illustrated depiction of this electrical contact means is specific to the preferred embodiment, as there are many other obvious means of making electrical contact with the voice coil actuator.

To further describe the installing of voice coil actuator with retainer 200, the voice coil actuator assembly 90 is slidably joined along its center axis that is coaxial with said receiving cavity 210. As the output disk 112 of the voice coil actuator is inserted in said cavity 210, the output disk 112 makes contact with a perimeter ring 216 which is semi-compressible and whose return forces diminish with time and will eventually set in the compressed, deformed position. The perimeter ring 216 acts to push the output disk 112 in front of the front surface of the retainer 200. In doing so, the front surface of the output disk 112 is projected into a position in front of registration means 203 which will interface with the wall cladding material once installed. With output disk 112 in such an outward position, when drywall or other wall cladding material is affixed to the wall studs it will push on the output disk 112 creating compressive forces and as a result compress the perimeter rings 216. An adhesive may be applied to the output disk prior to affixing the wall cladding material so as to create a bond between the output disk 112 and the wall cladding material. The perimeter ring 216 acts to ensure that positive pressure is applied to the interface between the output disk and the wall cladding material. Due to the deformation set properties of the perimeter rings 216, after a period of time the return forces of the perimeter ring will diminish to negligible values, leaving the voice coil actuator supported axially by the support ribs 208 of the retainer 200.

Means for retention 217 are provided to ensure the voice coil actuator does not fall to the ground after insertion into the retainer cavity 210, and before the wall cladding material is applied. Said means for retention are preferably a snap 217 on retainer 200 used in conjunction with a mating protrusion 218 on voice coil actuator assembly 90 and is more specifically shown in FIG. 11. The nature of the snap 217 is only to provide a means of stopping the voice coil actuator from dislodging from cavity 210. As previously described, the voice coil actuator must be able to move axially fore and aft along its central axis to effectively transmit energy to the soundboard represented as drywall in this preferred embodiment. The space 219 between the snap 217 and the mating protrusion 218 demonstrates a positive retention of the voice coil actuator, while permitting small axial movement.

Figure 12:
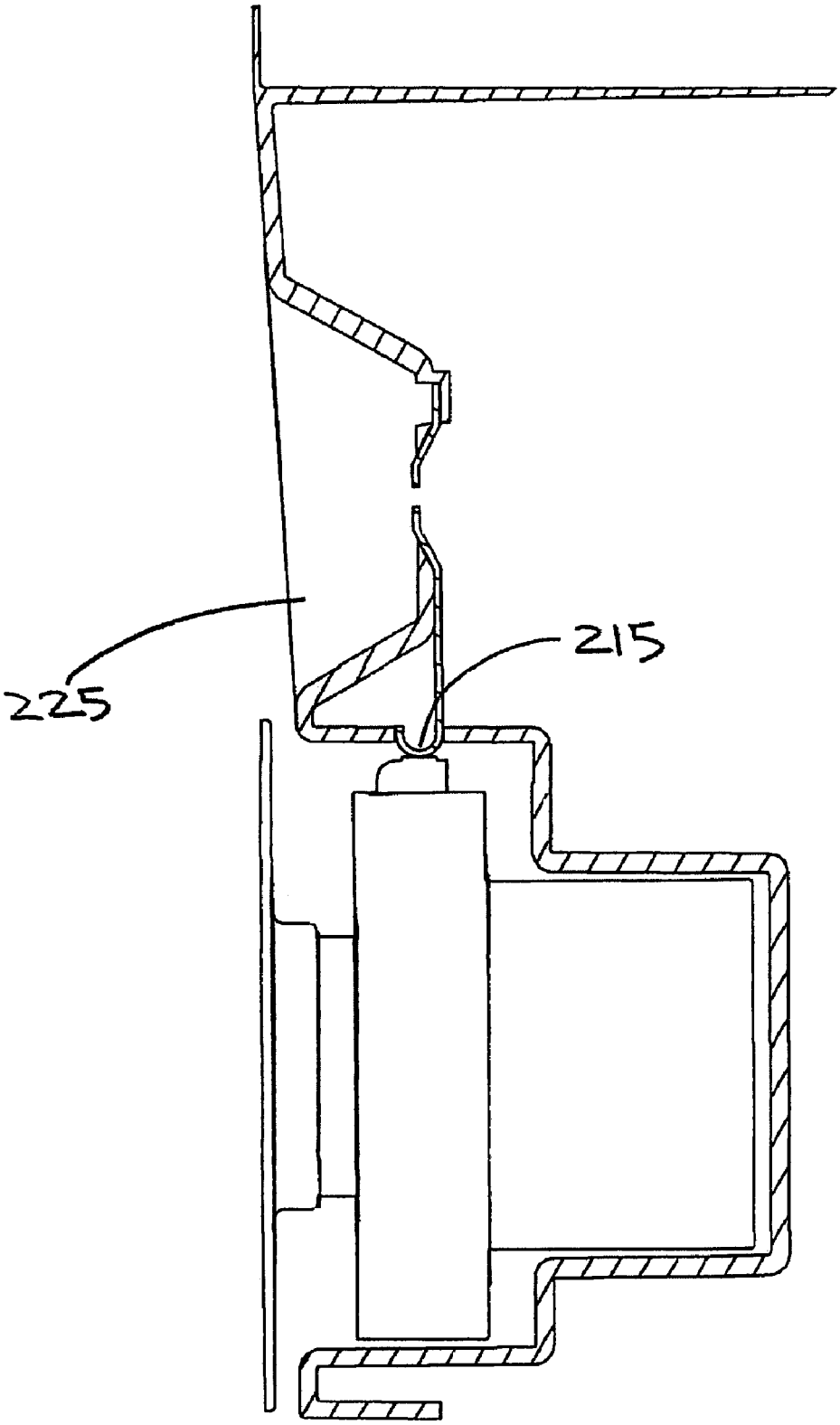
FIG. 12 is a cut away view of the retainer element at the height of an electrical contact means on the retainer element of the preferred embodiment.
Figure 13:
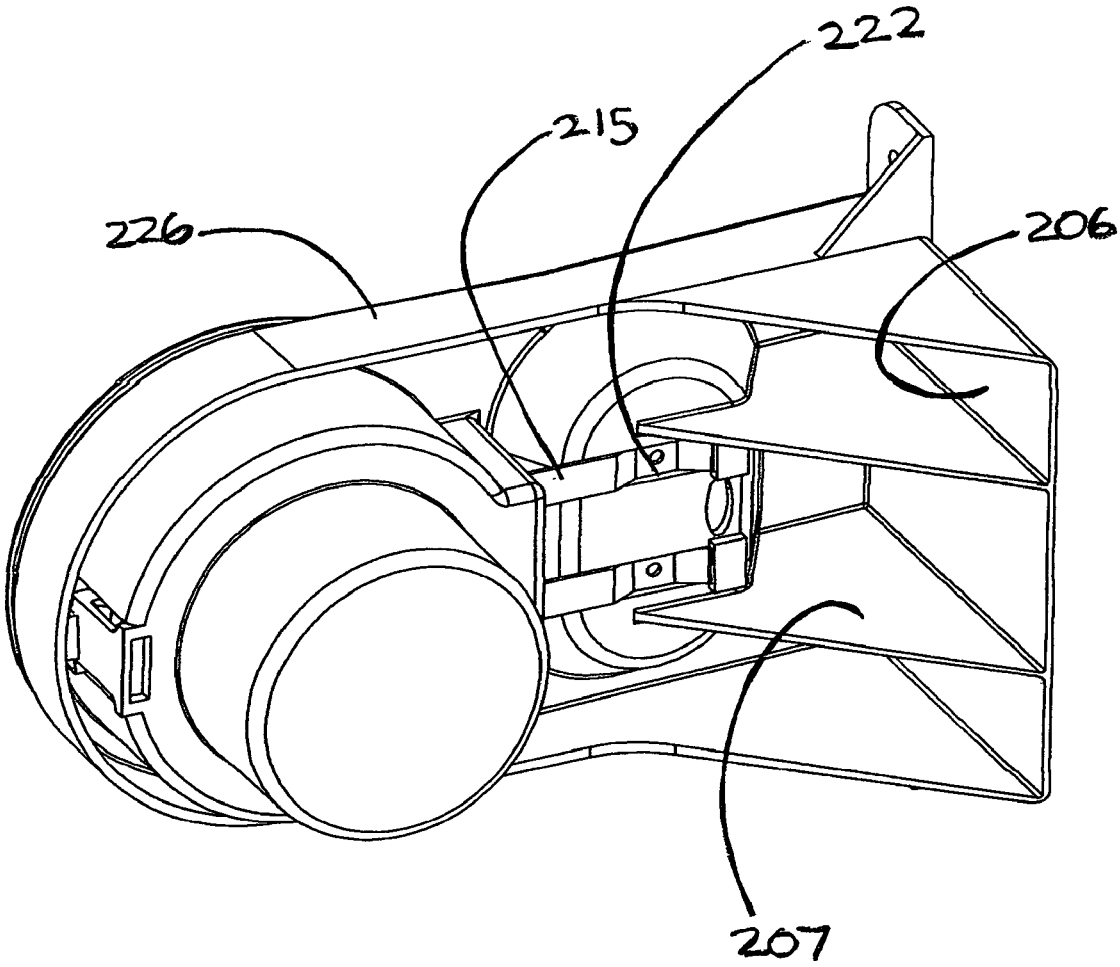
FIG. 13 is a perspective view of the rear of the retainer element of the third embodiment.

FIG. 12, FIG. 13 and FIG. 8 show the prolongation of each said at least one sprung contact 215. Each said sprung contact 215 is formed in such a way as to extend from its contact point with each of said at least one voice coil actuator contacts 214 to attach electrical wires which feed the voice coil actuator. The sprung contacts 215 of the preferred embodiment are formed of flat strip type conductive material, which registers in a raceway 222. Each contact 215 comprises at least one surface 223 formed to extend past a retainer wall 224, at least one threaded hole 220 to receive a binding post to affix electrical wires which send power and signal to drive voice coil actuator, and at least one opening 221 to allow electrical wires to be threaded through to access the wire contact surfaces 223 of contacts 215. A cavity 225 is recessed in said retainer 200 to provide clearance for wire binding posts and ensures the length of the wire binding posts are less than the depth of the cavity 225 so as not to interfere with the wall cladding material's installation. Reinforcing ribs 207 are shown, and prevent reward torque or bending of the retainer part 200 when wall cladding material such as drywall is installed and exerts torque forces through the voice coil actuator and the retainer 200. A combination of structural elements forming part of retainer 200 further assist with preventing bending or displacement of retainer 200 when the wall cladding material is applied as demonstrated by perimeter wall 226.

It should be noted that the preferred embodiment may be retrofitted to an existing wall by cutting a hole in the wall cladding material within the proximity of a wall stud reinforcing member and affixing the retainer 200 and voice coil actuator assembly 90 to any wall stud member. As the retainer 200 is cantilevered from a singular wall stud, and is of a distance less than one half of the distance between wall studs to the center axis of the voice coil actuator 200 in order to reduce resonant frequencies, the hole size required for the retrofitting would be small thus reducing the impact of retrofitting. Once installed, the wall surface is closed using standard construction practices.

Figure 14:
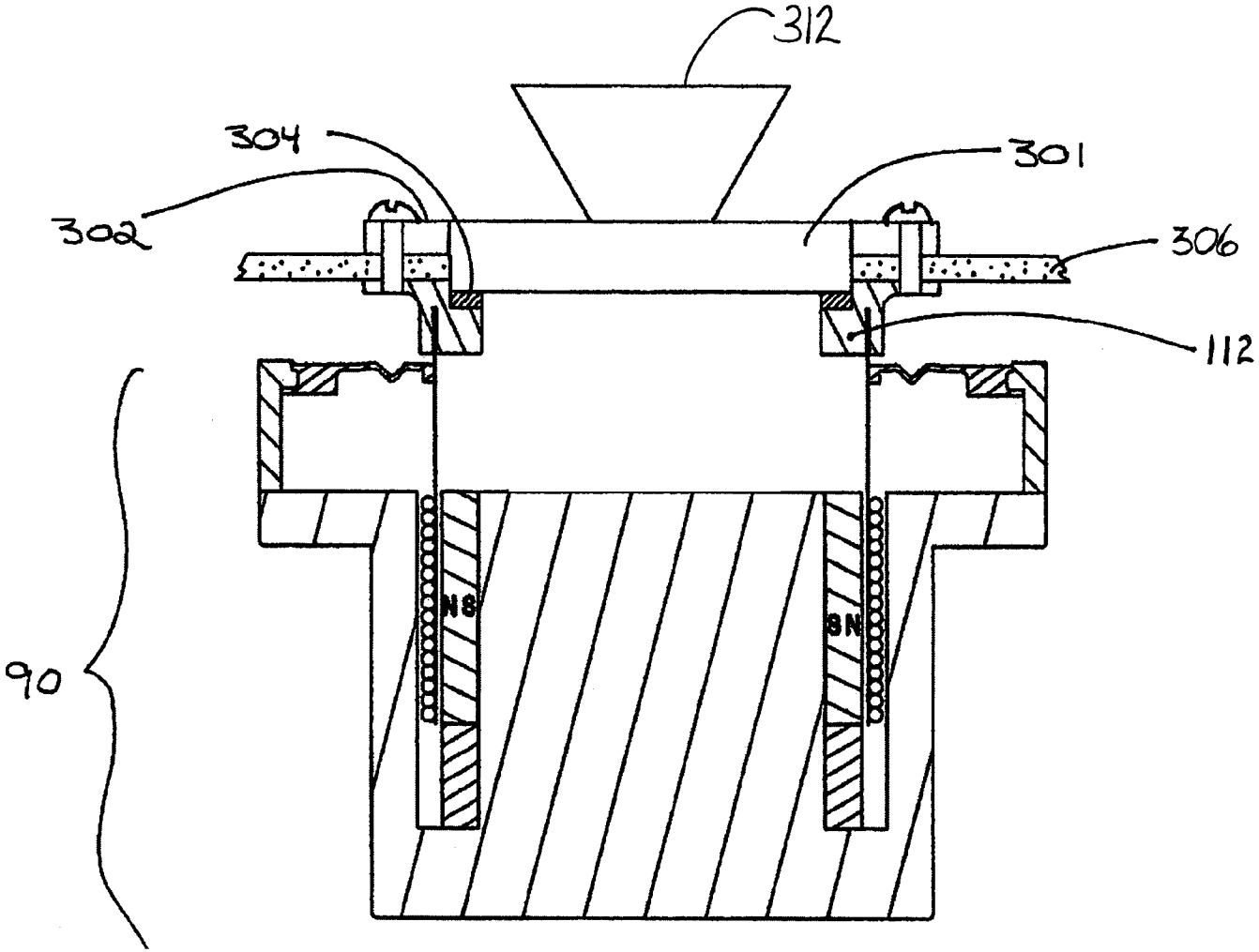
FIG. 14 is a cross sectional view of an inertial type voice coil actuator of a fourth embodiment showing a high frequency speaker element co-axially mounted within the output disk.
Figure 15:
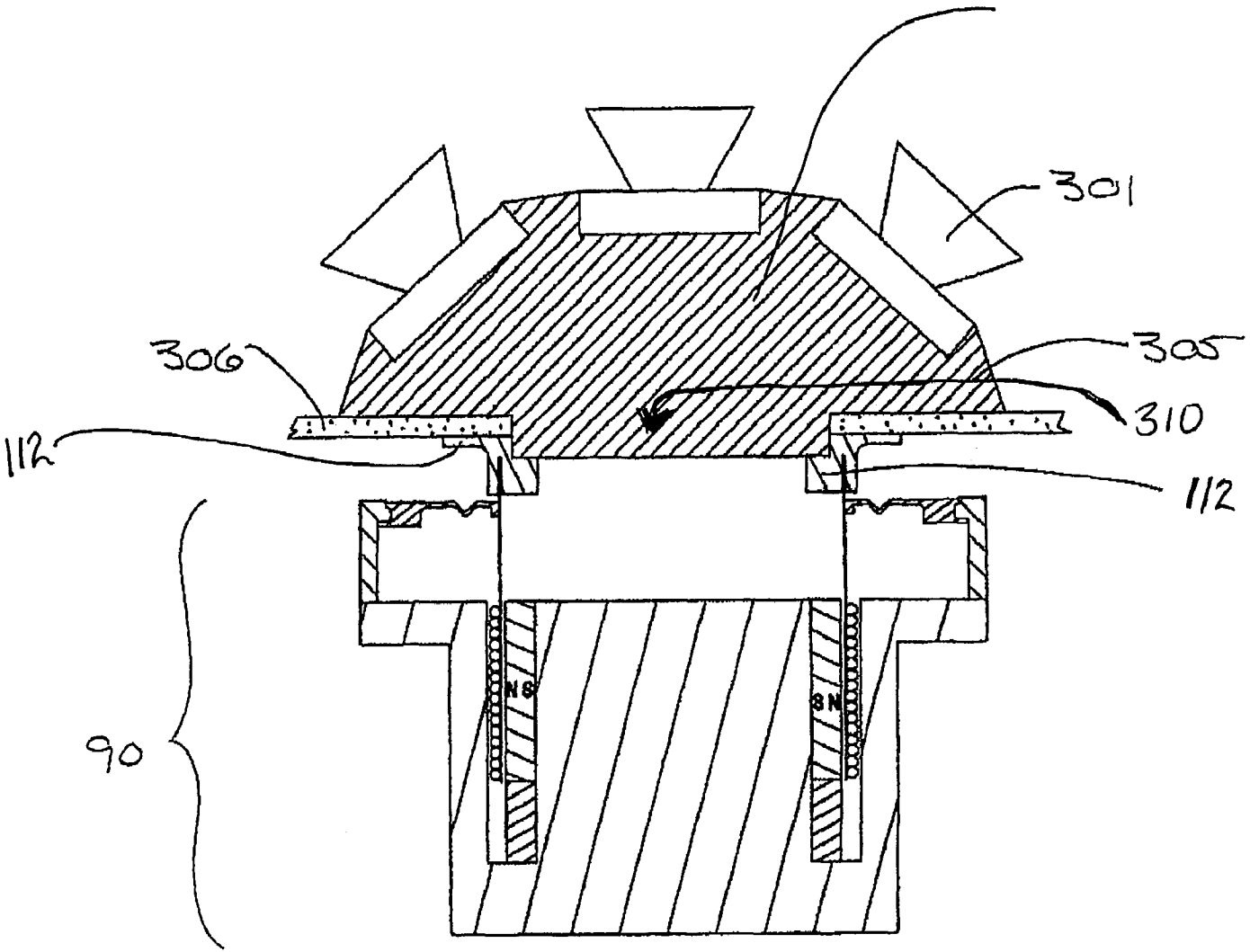
FIG. 15 is a cross sectional view of the fourth embodiment of the present invention showing a multi element, hemispherical, high frequency array.

A fourth embodiment is shown best in FIGS. 14 and 15. In FIG. 14 the integrated mounting apparatus includes output disk 112 comprising an annular hole 310. Said output disk 112 is attached to a soundboard member 306 by means of a clamping mechanism 302. Co-axially located with and generally covering the annular hole 310 of the output disk 112 is at least one high frequency speaker element 301. Said at least one high frequency speaker element 301 is mounted in such a manner that the acoustic output side 312 of each said speaker element 301 is facing the preferred direction for transmitting the acoustic response of the high frequency element of the system. A vibration isolation pad 304 may be positioned to be in communication with said output disk 112 and with each said high frequency element 301. The pad 304 will reduce the dynamic mass experienced by the voice coil actuator and minimize the structural vibration each high frequency speaker element 301.

Each said at least one high frequency speaker element 301 is positioned relative to the output disk 112 such that it penetrates through the soundboard 306 to minimize the protrusion of the high frequency speaker element 301 from the face of the soundboard 306. The speaker element 301 may be mechanically fixated through conventional means to either the soundboard 306 or the output disk 112.

This embodiment may also include the co-location of a plurality of high frequency speaker elements 301 mounted on a fixture 305 to fixedly position the high frequency speaker elements in relationship to each other. Acoustic radiation from a speaker element typically shows a focusing of the energy as the excitation frequency of the speaker element is increased. In an effort to reduce the focusing of the acoustic radiation with increasing frequency the elements are arranged generally so that the main response axes of the elements are not parallel. This may be accomplished through many orientations. A hemi-spherical arrangement drives the high frequency elements 301 in phase so that it behaves in similitude with a pulsating sphere. The acoustic soundboard 306 in this instance acts as a baffle, increasing the overall efficiency of the system.

The inertial type voice coil actuator illustrated in the drawings is to be viewed as having some important advantages, including improved force density, power rating and relatively constant sound quality, due to the radially polarized permanent magnets, uniform magnetic field, and heat dissipating characteristics of the magnetic viscous fluid and linear bearing system. In addition, advantages of simplified installation elements and high frequency response capability have been incorporated.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced otherwise than as specifically described.

What is claimed is:

1. An actuator comprising:

(a) An inertial type voice coil actuator assembly;

(b) said inertial type voice coil actuator assembly comprising:

1. A magnetic flux conductive material core having a continuous channel wherein said channel further comprises a first wall, a second wall, a bottom wall, and an antifringing groove;
2. A radially polarized cylindrical magnet spaced relative to said channel to form a magnetic gap between said magnet and said first wall of said channel;
3. A conductive coil;
4. A multi-component suspension system wherein said coil is associated with a coil former and disposed in said gap and further comprising an antifriction bearing for avoiding negative effects of bending moment caused by nonaxial forces, a viscous magnetic fluid, and a spider suspension; and (c) An integrated mounting apparatus.

2. An actuator comprising:

(a) An inertial type voice coil actuator assembly (b) said inertial type voice actuator assembly comprising:

1. A magnetic flux conductive material core having a first surface and a continuous channel disposed in said first surface, said channel having a bottom wall, a first wall and a second wall, said first wall including an anti-fringing groove near said bottom wall;
2. A cylindrical radially polarized magnet disposed in intimate contact with said second wall of said channel and spaced from said first wall, so that a gap remains between said magnet and said first wall, said magnet further being spaced from said bottom wall of said channel and adjacent said antifringing groove so that magnetic flux is substantially normal from said magnet across said gap;
3. An electrical current conductive coil;
4. A multi-component suspension system for moveably suspending said conductive coil within said gap;
5. Said multi-component suspension system comprising a coil former with which said coil is associated, a viscous magnetic fluid disposed in said channel to minimize radial movement of said coil and provide a restoring force, at least one spider suspension having a distal portion and associated with said coil former to further minimize radial movement while allowing full axial compliance of the coil, and an antifriction bearing positioned so as to provide additional protection against radial movement of the coil; and (b) An integrated mounting apparatus comprising an output disk to transmit vibrations from the coil and a receiver associated with a soundboard and further comprising means to interlock said receiver and said output disk.

3. An inertial type voice coil actuator as set forth in claim 1 wherein said antifriction bearing of said multi-component system is bounded by said magnet, said bottom wall of said channel and said second wall of said channel.

4. An inertial type voice coil actuator as set forth in claim 2 wherein said electrical current conductive coil is wound on said coil former and further comprising a first portion of said coil former positioned outside said magnetic gap, and a groove on said output disk into which said first portion of said coil former is inserted.

5. An inertial type voice coil actuator as set forth in claim 4 wherein said first portion of said coil former is bonded in said groove of said output disk.

6. An inertial type voice coil actuator as set forth in claim 4 wherein a spacer is attached to a first surface of the core and comprises means for attaching said distal portion of said spider suspension.

7. An inertial type voice coil actuator as set forth in claim 1 wherein said integrated mounting system comprises means to interlock an output disk and a receiver and further comprises: a distal surface on said output disk; a plurality of segmented helical wedges spaced apart one from another and positioned on said distal surface; an annular hole in said receiver having a depth and a base; a protruding segmented wall in said receiver formed by said annular hole having a plurality of openings each with an adjacent helicoidal opening comprising complementary shape and spacing to said helical wedges on said output disk such that upon correct alignment, the output disk may be placed in communication with said base and frictionally secured by a partial turn.

8. An inertial type voice coil actuator as set forth in claim 1 wherein said integrated mounting system comprises means to interlock an output disk and a receiver and further comprises: a distal surface on said output disk; at least one segmented helical wedge positioned on said distal surface; an annular hole in said receiver having a depth and a base; a protruding segmented wall in said receiver formed by said annular hole having at least one opening with an adjacent helicoidal opening comprising complementary shape and spacing to said at least one helical wedge on said output disk such that upon correct alignment, said output disk may be placed in communication with said base and frictionally secured by a partial turn.

9. The inertial voice coil actuator as set forth in claim 1 wherein said integrated mounting apparatus comprises an output disk acoustically associated with said coil former and a soundboard.

10. The inertial voice coil actuator as set forth in claim 1 wherein said viscous magnetic fluid is disposed in said channel, said at least one spider suspension comprises a distal portion, and said antifriction bearing is positioned near said bottom wall of said channel and further comprising a groove in an output disk into which said coil former is positioned.

11. An inertial type voice coil actuator as set forth in claim 2 wherein said means to interlock said output disk and said receiver comprises: a distal surface on said output disk; a plurality of segmented helical wedges spaced apart one from another and positioned on said distal surface; an annular hole in said receiver having a depth and a base; a protruding segmented wall in said receiver formed by said annular hole having a plurality of openings each with an adjacent helicoidal opening comprising complementary shape and spacing to said helical wedges on said output disk such that upon correct alignment, the output disk is placed in communication with said base and frictionally secured by a partial turn.

12. An inertial type voice coil actuator as set forth in claim 1 wherein said spider is associated with a spacer and with a first portion of said coil former that is external said magnetic gap.

13. An inertial type voice coil actuator as claimed in claim 7 wherein said distal surface of said output disk is convex for evenly distributing downward pressure upon said partial turn of the output disk.

14. An inertial type voice coil actuator as set forth in claim 7 wherein means to interlock further comprises a locking means to prevent the output disk from counter rotating.

15. An inertial type voice coil actuator as set forth in claim 14 wherein said locking means comprises at least one locking snap wedge integral to said distal surface and an opening in said annular hole wherein said snap wedge springs into said opening and engages said protruding segmented wall.

16. An inertial type voice coil actuator as set forth in claim 15 wherein said at least one locking snap wedge is associated with at least one flexural hinge and a release tab positioned such that pressure on said tab deflects said locking snap wedge allowing rotation for removal of said output disk.

17. An actuator comprising:

(a) An inertial type voice coil actuator assembly;

(b) said inertial type voice coil actuator assembly comprising:

2. A magnetic flux conductive material core having a first surface and a continuous channel disposed in said first surface, said channel having a bottom wall, a first wall and a second wall, said second wall including an anti-fringing groove near said bottom wall;

2. A cylindrical radially polarized magnet disposed in intimate contact with said first wall of said channel and spaced from said second wall, so that a gap remains between said magnet and said second wall, said magnet further being spaced from said bottom wall of said channel and adjacent said antifringing groove so that magnetic flux is substantially normal from said magnet across said gap;

3. An electrical current conductive coil;

4. A multi-component suspension system for moveably suspending said conductive coil in said gap such that an electrical current in said coil displaces said coil and said coil remains fully within said gap;

5. Said multi-component suspension system further comprising a coil former with which said coil is associated, a viscous magnetic fluid disposed in said channel to minimize radial movement of said coil and provide a restoring force, at least one spider suspension having a distal portion and associated with said coil former to further minimize radial movement while allowing full axial compliance of the coil, and an antifriction bearing positioned so as to provide additional protection against radial movement of the coil; and (c) An integrated mounting system comprising an output disk to transmit vibrations from the coil and a receiver associated with a sound board and further comprising means to interlock said output disk and said receiver.

18. An inertial type voice coil actuator in accordance with claim 12 wherein a plurality of said disked shaped spiders are disposed each with a distal portion in contact with said spacer and in contact with said first portion of said coil former.

19. An actuator comprising:

(a) An inertial type voice coil actuator assembly;

(b) said inertial type voice coil actuator assembly comprising:

1. A magnetic flux conductive material core having a continuous channel wherein said channel further comprises a first wall, a second wall, a bottom wall, and an antifringing groove;

2. A radially polarized cylindrical magnet spaced relative to said channel to form a magnetic gap between said magnet and said first wall of said channel;

3. A conductive coil; and

4. A multi-component suspension system wherein said coil is associated with a coil former and disposed in said gap and further comprising an antifriction bearing for limiting radial movement of said coil former, a viscous magnetic fluid, and a spider suspension; and (c) An integrated mounting apparatus comprising an output disk, a voice coil actuator retainer, and means to affix said output disk to a soundboard inside an infrastructure.

20. The inertial type voice coil actuator as claimed in claim 19 wherein said integrated mounting apparatus further comprises means to associate said retainer with said infrastructure.

21. The inertial type voice coil actuator as claimed in claim 20 wherein said means to associate said retainer with said infrastructure comprises a front depth registration means, a brace, at least one securing tab, and at least one hole.

22. The inertial type voice actuator as claimed in claim 20 wherein said retainer comprises receiving means into which said voice coil actuator assembly is disposed.

23. The voice coil actuator as claimed in claim 22 further comprises co-locating registration means and said receiving means comprises a receiving cavity.

24. The voice coil actuator as claimed in claim 23 wherein said co-locating registration means comprises a contact protrusion opening on said retainer and at least one sprung electrical contact, and said voice coil actuator assembly further comprises a contact protrusion and at least one voice coil actuator electrical contact such that upon disposal of said assembly in said cavity, said at least one sprung electrical contact and said at least one voice coil actuator electrical contact are in electrical communication.

25. The voice coil actuator as claimed in claim 24 wherein said receiving cavity further comprises horizontal rib guides and vertical ribs to guide said voice coil actuator assembly into said cavity.

26. The voice coil actuator as claimed in claim 22 wherein said retainer further comprises a perimeter ring against which said output disk is positioned to provide compression force between said output disk and said soundboard.

27. The voice coil actuator as claimed in claim 22 wherein said integrated mounting apparatus further comprises means for retention of said voice coil actuator assembly in said receiving means.

28. The voice coil actuator as claimed in claim 27 wherein said means for retention comprises a snap on said retainer, a mating protrusion on said voice coil actuator assembly, and when said voice coil actuator is disposed in said retainer, a space therebetween to allow for axial movement.

29. The voice coil actuator as claimed in claim 24 further comprising means for retention of said voice coil actuator assembly in said retainer cavity having a snap on said retainer, a mating protrusion on said voice coil actuator assembly, and a space therebetween to allow for axial movement and wherein said at least one voice coil actuator electrical contact and said at least one sprung electrical contact remain in electrical communication during said axial movement.

30. An actuator comprising:

(a) An inertial type voice coil actuator assembly;

(b) said inertial type voice coil actuator assembly comprising:

1. a magnetic flux conductive material core having a continuous channel wherein said channel further comprises a first wall, a second wall, a bottom wall, and an antifringing groove;
2. a radially polarized cylindrical magnet spaced relative to said channel to form a magnetic gap between said magnet and said first wall of said channel;
3. a conductive coil;
4. a multi-component suspension system wherein said coil is associated with a coil former and disposed in said gap and further comprising an antifriction bearing for avoiding negative effects of bending moment caused by nonaxial forces, a viscous magnetic fluid, and a spider suspension; and (c) An integrated mounting apparatus comprising an output disk having an annular hole, at least one high frequency speaker element comprising an output side, and means for associating said output disk with a soundboard such that said at least one high frequency speaker element is generally located proximal with said annular hole and penetrates through said soundboard.

31. The inertial type voice coil actuator set forth in claim 30 wherein said integrated mounting apparatus further comprises a vibration pad positioned between and in communication with said at least one high frequency speaker element and said output disk to minimize structural vibration.

32. The inertial type voice coil actuator set forth in claim 30 wherein said at least one high frequency speaker element is spatially fixed relative to all said at least one high frequency speaker elements such that focusing of acoustic radiation is reduced.

33. An actuator comprising:

a) An inertial type voice coil actuator assembly;

b) said inertial type voice coil actuator assembly comprising:

1. A magnetic flux conductive material core having a continuous channel wherein said channel further comprises a first wall, a second wall, a bottom wall, and an antifringing groove;
2. A radially polarized cylindrical magnet spaced relative to said channel to form a magnetic gap between said magnet and said first wall of said channel;
3. A conductive coil;
4. A multi-component suspension system wherein said coil is associated with a coil former and disposed in said gap and further comprising an antifriction bearing for limiting radial movement of the coil former caused by bending moment, a viscous magnetic fluid, and a spider suspension wherein said antifriction bearing is bounded by said magnet, said bottom wall of said channel and said second wall of said channel; and c.) An integrated mounting apparatus.

34. An actuator comprising:

a) An inertial type voice coil actuator assembly;

b) said inertial type voice coil actuator assembly comprising:

1. A magnetic flux conductive material core having a continuous channel wherein said channel further comprises a first wall, a second wall, a bottom wall, and an antifringing groove;
2. A radially polarized cylindrical magnet spaced relative to said channel to form a magnetic gap between said magnet and said first wall of said channel;
3. A conductive coil;
4. A multi-component suspension system wherein said coil is associated with a coil former and disposed in said gap and further comprising an antifriction bearing for avoiding negative effects of bending moment caused by nonaxial forces, a viscous magnetic fluid, and a spider suspension; and
5. An integrated mounting apparatus wherein said integrated mounting apparatus comprises means to interlock an output disk and a receiver and further comprises: a distal surface on said output disk; at least one segmented helical wedge positioned on said distal surface; an annular hole in said receiver having a depth and a base; a protruding segmented wall in said receiver formed by said annular hole having at least one opening with an adjacent helicoidal opening comprising complementary shape and spacing to said at least one helical wedge on said output disk such that upon correct alignment, said output disk may be placed in communication with said base and frictionally secured by a partial turn.

* * * * *